United States Patent [19]

Walter

[11] 4,361,244

[45] Nov. 30, 1982

[54] PILFERPROOF CLOSURE

[75] Inventor: John Walter, Evergreen Park, Ill.

[73] Assignee: The Continental Group, Inc., Stamford, Conn.

[21] Appl. No.: 242,757

[22] Filed: Mar. 11, 1981

[51] Int. Cl.[3] ..... B65D 39/04

[52] U.S. Cl. ..... 215/253; 215/237; 220/269

[58] Field of Search ..... 215/235, 237, 253; 220/269, 270, 271

[56] References Cited

U.S. PATENT DOCUMENTS

| | | | |
|---|---|---|---|
| 3,080,088 | 3/1963 | Corrinet | 220/307 X |
| 3,106,311 | 10/1963 | Fairchild | 220/307 |
| 3,127,064 | 3/1964 | Fairchild | 222/541 X |
| 3,465,906 | 9/1969 | Wagner et al. | 215/253 |
| 3,651,992 | 3/1972 | Hazard | 220/266 |
| 3,656,648 | 4/1972 | Powaloski et al. | 215/253 |
| 3,743,129 | 7/1973 | Willis et al. | 220/269 X |
| 3,744,662 | 7/1973 | Zundel | 220/269 |
| 4,006,839 | 2/1977 | Thiel et al. | 220/266 |
| 4,200,196 | 4/1980 | Bashour | 215/253 |

*Primary Examiner*—Donald F. Norton
*Attorney, Agent, or Firm*—Charles E. Brown

[57] ABSTRACT

A closure for a container having a lever-openable plug wherein the lever is attached to other parts of the closure by a frangible member which must be broken to permit actuation of the lever to open the plug, thus indicating to a subsequent observer that either the closure had been open or an attempt had been made to do so.

11 Claims, 6 Drawing Figures

FIG. 4
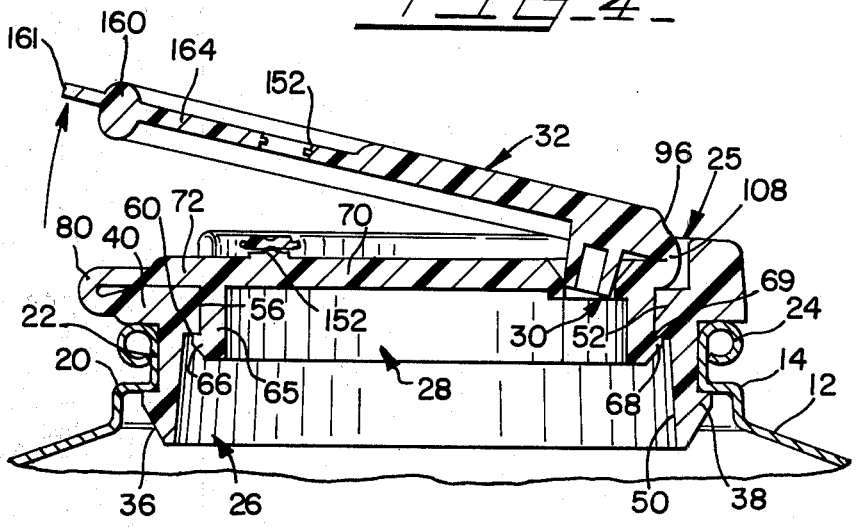
FIG. 6
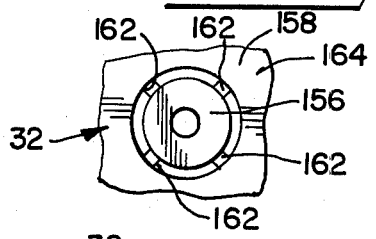
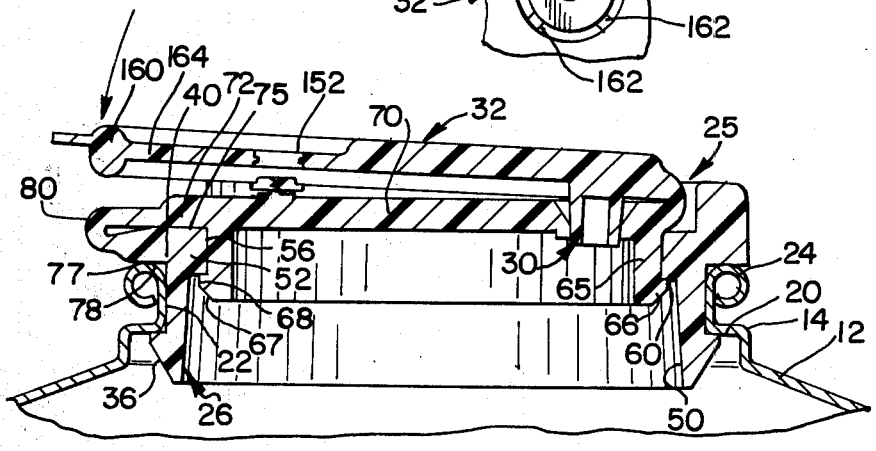
FIG. 5

PILFERPROOF CLOSURE

BACKGROUND OF THE INVENTION

Containers of the type under consideration include a cylindrical body with either an integral or seamed bottom and have a domed or narrow upper end with a neck which is associated with a closure.

Various closures for the small diameter neck are available. Such closures are shown in U.S. Pat. Nos. 3,251,499, 3,999,678 and 4,149,651.

DESCRIPTION OF THE PROBLEM

After considering various types of snap-in closures of the types heretofore discussed, a number of problems were noted. Some of the most objectionable problems have been the lack of consistent positive closure under pressure and which is also relatively easy to open and simple to adapt to high speed manufacture and application and are easily detectable as having been opened. Structures of the general type under consideration have been heretofore made, but are more costly and the best references require a closure which must be torn open to reveal pilferage.

SOLUTION OF THE PROBLEM

The snap-close closure of the instant invention has been made not only to minimize the amount of material used but also provides a novel combined venting and opening-facilitating leverage structure with enhanced sealing integrity as well as an indication of pilferage. The pilferage indicator is associated with the opening lever structure such that once the lever is lifted, it breaks apart a readily apparent nonrepairable frangible tie or tether of the indicator and forms a hole through the center of the lever. Tampering is thus readily evident. The lever is formed to spring up when it is broken away from the indicator and thus the apparent tampering is readily perceivable by the customer.

SUMMARY OF THE INVENTION

This invention is directed to closures and, more particularly, to a pilfer indicator for such closures.

A main object of the invention is to provide a closure which may be easily manufactured in a simple single molding operation and may be machine-folded and the lever portion thereof tethered prior to application to the container.

A further object is to provide a novel closure having several parts tethered to each other and which are recloseable and in which the structure indicating tampering also holds the uppermost or lever portion of the closure tightly against the top of the closure plug.

Another object is to provide a plastic closure which is made as a single unit in a simple molding operation.

Another object is to provide a novel opening lever arrangement which first breaks the tamper-indicating indicia, then opens a vent and then pries the closure open with relatively small effort.

These and other objects inherent in and encompassed by the invention will become more apparent from the specification and the drawings wherein:

FIG. 4 is a sectional view similar to FIG. 3 but showing the parts with the pilfer-indicator broken preparatory to opening the closure;

FIG. 5 is another sectional view similar to FIG. 3, and shows the parts reclosed; and FIG. 6 is an enlarged top plan view of a portion of the handle showing the pilferproof structure.

DESCRIPTION OF THE INVENTION

Figure 1:
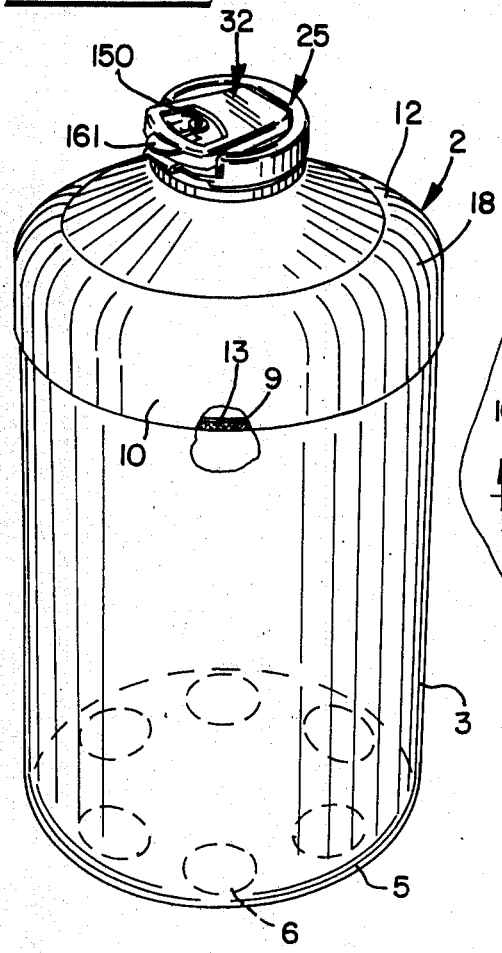
FIG. 1 is a perspective view of a container with a closure incorporating the invention.
Figure 2:
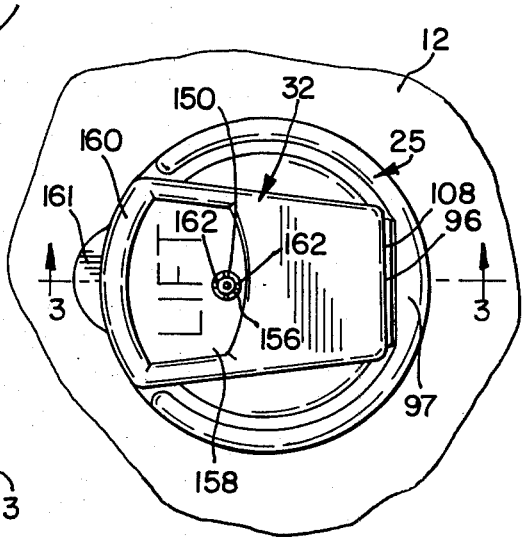
FIG. 2 is an enlarged fragmentary top plan view.

The invention is shown applied to a container 2 made of metal such as aluminum and comprising a cylindrical body 3 with an integral outwardly convexed bottom 5 which is provided with outwardly protruding dimples 6 upon which the container rests. It will be understood that the invention is applicable to other types of containers.

The upper open end portion of the body 3 has a necked-in portion 9 which fits into an annular skirt portion 10 of a dome member 12 which forms the upper end of the container. A suitable adhesive 13 bonds the portion 9 to the skirt 10. The dome member 12 is formed with a stepped neck 14 and a toroidal section 18. The member 12 provides at the upper end of the container on neck 14 a shoulder 20 and an access opening 22, the neck 14 terminating in a curl 24.

A closure 25 formed of thermoplastic materials is provided at the upper end of the container and comprises a tubular neck or sleeve portion 26, a closure plug portion 28 and a venting portion 30 to which is attached a finger grip lever or handle 32.

The neck portion 26 is a cylindrical member which at its lower end is tapered at 36 and is tightly wedged through the opening 22 (FIG. 3) and then expands radially outwardly and engages its shoulder 38 under the lower edge of shoulder 20 of the neck 14.

The neck portion 26 has an upper outwardly projecting annular flange 40 which engages the top edge of the curl 24 and provides a fluid-tight pressure seal with the shoulder 38.

The interior bore surface 50 of the neck portion 26 provides a pour and fill opening within which there is located a locking ring member or annular shoulder 52 with a bottom locking surface 60 which extends normal to the axis of the neck portion.

The plug 28 has a cylindrical side wall 65 which adjacent to its lower edge is provided with an annular locking ring or rib 66 which is of generally triangular cross-section having a lower downwardly tapered pilot surface 67 which is adapted to be guided with the inner face 56 of the neck or sleeve locking ring 52 when the plug or cap is pressed into the neck opening or bore 50 whereupon the apical edge 68 on ring 66 is deflected and the locking ring or shoulder 66 on the cap or plug slips under the shoulder 52 of the neck and a flat radially outwardly extending surface 69 at the upper side of the shoulder 66, normal to the axis of the neck or sleeve, locks under the face 60.

The plug or cap 28 has a top wall 70 integral with the upper end of the side wall 65, the wall 70 extending beyond the perimeter of the side wall and forms an annular rim portion 72 which on its underside is pressed in position against the top surface 75 of the annular flange 40 integral with and extending radially outwardly from the upper end of the neck portion 26. The bottom side 77 of flange 40 presses against the crest 78 (FIG. 5) of the curl 24 of the metal neck 14.

A tether in the form of a narrow strap 80 connects a peripheral edge of flange 72 with a peripheral edge of portion 40 of the neck portion 26.

The wall 70 is provided close to its marginal edge with a vent opening 84 in an area diametrically opposite to the tether 80 adjacent to the interior surface of the wall 65 of the plug.

A frusto-conical pilot cavity 86 is formed at the upper end of opening 84 for guiding the male venting closure pin or element 30 which in the closed position extends into the opening 84.

The upper end of the closure element or vent pin 30 depends from and is integrally connected with the lever member 32 intermediate its ends. The lever or handle 32 has a fulcrum end 96 which engages with the top edge the thickened portion of a combination pouring lip and fulcrum rim 97 formed on the top side of the flange 40. The lever 32 is connected below the fulcrum end 96 to one end of a narrow strap 108 which is folded and which has its other end connected to the outer edge of flange 72 in an area diametrically opposite the strap 80.

A feature of the invention is the provision of a pilferproof structure 150 which comprises a post 152 which is formed integral with the top wall 70 and projects upwardly therefrom through an opening and is heat-bonded at 152 to a disk 156 which is formed in the intermediate portion 158 of the handle 32 in the plane thereof. The disk 156 is connected by a series of frangible straps or tethers 162 to the depressed body edge section 164 of the handle portion 158. The handle has a peripheral reinforcing rib 160 and a lift tab 161 facilitating entry of a finger thereunder.

Figure 3:
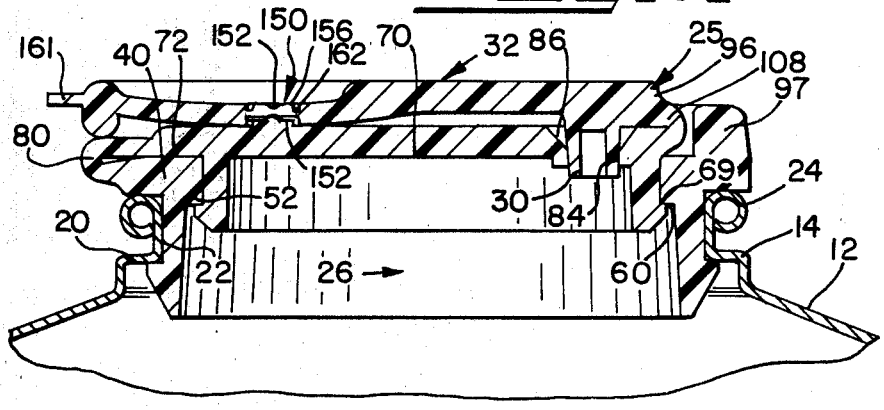
FIG. 3 is a fragmentary vertical cross-sectional view taken substantially on line 3—3 of FIG. 2.

Thus, to open the closure shown closed in FIG. 3, the user lifts on portion 161 diametrically opposite the strap 108 and breaks the straps 162 and lifts the fulcrum end portion 96 outwardly and withdraws the vent plug 30 from opening 84. Continued rotation of the lever or handle engages the fulcrum portion 96 against the rim or ledge 97 and further pivotal movement rightwardly (FIGS. 3 & 4) pries the plug 28 out of the sleeve portion 26. Removal of the pin or plug 30 enhances the flexibility of wall 70 and the plug wall 65 in the immediate area and thus the flexure of that portion of the wall 65, that is, in the region of the vent opening whereby as the lever is fulcrummed, it pulls on the tether 108 which, in turn, curls the adjacent portion 72 of the top wall 70 upwardly and causes the portion of the wall 70 contiguous to the vent opening to warp radially inwardly thus facilitating partially unhooking of the ledge or shoulder 66 from under the shoulder 52 and disengaging the locking face 69 from face 60. The plug 28 then easily lifts out of the neck or sleeve opening and with the handle or lever portion 30 lays to one side of the pour opening 50 and may be grasped by the user so as not to obstruct pouring.

To reclose the closure, the plug 28 of the closure is pressed into the sleeve opening until the shoulder 52 snaps under the shoulder 66. Then the handle or leve is folded over the cap 28 and the vent plug or pin 30 is pressed into the vent opening 84. Since the pilfer-indicating straps 162 have been broken, it will be apparent to the observer that there is a strong probability that the closure has been previously opened. However, the pilferproof feature in no way interferes with the reclosing of the closure. The lever is so molded that when tacked down as in FIG. 3, it is stressed and biased upwardly so that when released by breaking stops 162, it will assume the position shown in FIG. 5 which brings attention to the possible pilfering.

I claim:

1. A closure for a container having a wall member with an aperture, said closure comprising a sleeve portion having means for forming a seal-tight fit within a container aperture and having a bore providing a pour opening, a flexible plastic plug having a seal-tight fit within said pour opening, a lift lever connected to said plug, and a combination pour lip and fulcrum projecting from said sleeve portion for fulcruming engagement by said lever upon lifting and tilting of said lever to thereby open said pour opening by lifting said plug out of said pour opening, a tearable anti-pilfer means on said lever, means connecting said anti-pilfer means to said plug, said anti-pilfer means being torn apart upon lifting of said lift lever.

2. A closure for a container having a wall member with an aperture, said closure comprising a tubular sleeve portion having means for forming a seal-tight fit within a container aperture and providing a pour opening, a resilient plug having in a closed position of said plug a seal-tight fit within said opening, a lift lever, means tethering said lift lever to said plug, said lift lever having a fulcrum end and a lift end, and combination fulcrum and lip guide means on said sleeve portion extending axially thereof, said lift lever being swingable over said combination means for prying said plug out of said opening, and frangible tamper-indicating means on said lift lever connected to said plug and being separable attendant to lifting of said lift lever.

3. The invention according to claim 2 and said tamper indicating means comprising a tear apart portion of said lever.

4. The invention according to claim 3 and said tear apart portion of said lift lever comprising a disk-like element formed as part of said lift lever intermediate its ends, and means connecting said element to said plug.

5. In combination with a container having an aperture and a closure, said closure comprising a sleeve fitted into said aperture, means providing a seal between said sleeve and said container, said sleeve having a bore defining a pour opening, a plug having a seal fit with said sleeve in closed position of said plug within said opening, a lever overlying said plug in the closed position of said plug, a tether connecting one end of said lever to said plug, and a fulcrum on said sleeve having an upper end positioned for engagement by said lever attendant to said lever being swung beyond a predetermined angle whereupon said lever is caused to pivot on said fulcrum and pull on said tether and thus lift said plug out of said opening, and separable pilfer-indicating means connected between said lever and said plug.

6. A closure for a container having an aperture, said closure being means for closing a container aperture and comprising a sleeve insertable into an aperture in a container and having a pouring bore, a plug insertable into said pouring bore for closing said pouring bore, lifting means operably associated with said plug for displacing said plug from said pouring bore, and frangible pilfer-indicating means between said plug and said lifting means, said pilfer-indicating means being of the type adapted to break apart attendant to lifting of said lifting means, said lifting means comprising a tab overlying said plug in the closed position of said plug.

7. The invention according to claim 6 and said pilfer-indicating means comprising a wafer-like member recessed within said tab and having a frangible connection therewith, and upon breaking away from said tab, leaving a visibly apparent hole therein.

8. The invention according to claim 7 and said closure being made of thermoplastic materials, said plug having a top wall including an upstanding post, and a tack-weld connection between said post and said wafer-like member.

9. The invention according to claim 8 and said wafer-like member being joined to said tab by at least one breakable strap.

10. A closure for a container neck having a pour opening, said closure comprising closure means for closing said pour opening, lift means for displacing said closure means from a closed to an open position with respect to said pour opening, and pilfer-indicating means having a frangible connection between said lift means and said closure means and adapted to be fractured attendant to lifting of said lift means and thereby providing indicia of pilfering, said lift means being disposed in overlapped position to said closure means in the closed position of said closure, and said pilfer-indicating means comprising a breakaway portion of said lift means breakable away therefrom upon lifting of said lift means, and lift-force transmitting means tethering said lift means to said closure means, and said breakaway portion of said lift means being spaced from said tethering means and upon being broken away forming a visually apparent hole through said lift means.

11. The invention according to claim 10 and said lift means comprising a tab, said tethering means being located at one end of said lift means, said tab having a hand-hold at its other end, and said breakaway portion being located on the tab intermediate its ends.

* * * * *